US010821458B2

(12) United States Patent
Hopkin

(10) Patent No.: US 10,821,458 B2
(45) Date of Patent: Nov. 3, 2020

(54) LIQUID DISPENSING DEVICE

(71) Applicant: Hydro Systems Europe Ltd., Bracknell, Berkshire (GB)

(72) Inventor: Christopher Hopkin, Bracknell (GB)

(73) Assignee: Hydro Systems Europe Ltd., Bracknell (GB)

( * ) Notice: Subject to any disclaimer, the term of this patent is extended or adjusted under 35 U.S.C. 154(b) by 0 days.

(21) Appl. No.: 16/291,616

(22) Filed: Mar. 4, 2019

(65) Prior Publication Data

US 2020/0282415 A1 Sep. 10, 2020

(51) Int. Cl.
*B05B 11/00* (2006.01)

(52) U.S. Cl.
CPC ..... *B05B 11/3061* (2013.01); *B05B 11/3001* (2013.01)

(58) Field of Classification Search
USPC ..... 222/321.1–321.9, 153, 13, 153.14, 222/153.09, 628, 180, 181.1–181.3, 182
See application file for complete search history.

(56) References Cited

U.S. PATENT DOCUMENTS 8,511,514 B2 * 8/2013 Lee ..... B05B 11/3056 222/153.13
8,851,331 B2 * 10/2014 Pelkey ..... A47K 5/1202 222/181.3

(Continued)

FOREIGN PATENT DOCUMENTS

EP 0173885 A2 3/1986
GB 2506608 A 4/2014

(Continued)

OTHER PUBLICATIONS

European Patent Office, European Search Report in EP18161060, dated Jul. 25, 2018.

(Continued)

*Primary Examiner* — Lien M Ngo
(74) *Attorney, Agent, or Firm* — Wood Herron & Evans LLP

(57) ABSTRACT

The present invention relates to a liquid dispensing device. The device has a main housing, and comprises: a liquid delivery pump, comprising: an inlet; an outlet; a piston, disposed in a cylinder, the piston being movable in a liquid delivery direction between a first position and a second position, and in a liquid priming direction between the second position and the first position; and resilient means for biasing the piston in the liquid priming direction; an operating button, movable between a first position and a second position, and configured to act on the piston to move the piston in the liquid delivery direction; and resilient means for biasing the operating button in the liquid priming direction independently of said piston. In one embodiment, the operating button comprises locking means, configured to engage with the main housing to substantially prevent movement of said operating button in the liquid delivery direction until the operating button and the piston are in their respective first positions. In a further embodiment, the device further comprises a dosing ring configured to limit movement of said operating button in the liquid delivery direction, the dosing ring being adjustably mounted on a support member to enable the volume of liquid dispensed to be adjusted.

12 Claims, 11 Drawing Sheets

(56) References Cited

U.S. PATENT DOCUMENTS

| | | | | |
|---|---|---|---|---|
| 9,737,903 | B2 * | 8/2017 | Notarianni | B05B 11/3014 |
| 9,789,503 | B2 * | 10/2017 | Tada | B05B 11/0067 |
| 9,955,765 | B2 * | 5/2018 | Schmitz | B05B 11/3014 |
| 2004/0011822 | A1 * | 1/2004 | Jennings | A61M 15/0065 222/321.8 |
| 2005/0263545 | A1 | 12/2005 | Ophardt | |
| 2010/0059550 | A1 * | 3/2010 | Ciavarella | A47K 5/1207 222/325 |
| 2010/0084433 | A1 * | 4/2010 | Cater | A61M 15/0065 222/153.13 |
| 2010/0252568 | A1 * | 10/2010 | Ciavarella | A47K 5/1202 222/1 |
| 2011/0062186 | A1 * | 3/2011 | Julia | B05B 11/0059 222/153.04 |
| 2011/0062188 | A1 * | 3/2011 | Lemaner | B05B 11/3057 222/162 |
| 2015/0292931 | A1 | 10/2015 | Penfold | |

FOREIGN PATENT DOCUMENTS

| | | | |
|---|---|---|---|
| GB | 2506609 | A | 4/2014 |
| WO | 9723156 | A1 | 7/1997 |

OTHER PUBLICATIONS

Intellectual Property Office, Search and Exam Report in GB1703888.6, dated Oct. 2, 2017.

* cited by examiner

LIQUID DISPENSING DEVICE

The present invention relates to a liquid dispensing device, and in particular to a liquid dispensing device for use in dispensing metered doses of chemicals, such as liquid cleaning chemicals.

Chemical cleaning products are often provided in concentrated form, and require accurate dosing of the concentrated product. The concentrate is generally mixed with water to make the desired cleaning solution. Such cleaning solutions may be used in environments such as healthcare facilities, hotels, restaurants, and the like. Dispensing devices suitable for this purpose are known, and generally comprise a piston and cylinder arrangement which draws, in a priming stroke, a known volume of liquid to be dispensed in a delivery stroke. The volume of liquid delivered may be adjusted by adjusting the travel of the priming stroke.

Often, such known systems do not adequately prevent a user from operating the dispensing device before completion of the priming stroke—a so-called "double-dose". In such circumstances, the volume of liquid dispensed in the delivery stroke is unknown, but less than the intended dose. This is less than desirable, especially where the accuracy of the dilution ratio is critical for the chemical solution to work as required. Although some known devices have been provided with features for attempting to prevent such double-dosing, there remain problems, such as the user not knowing when the device is primed and ready to dispense.

It is therefore an object of the present invention to provide an improved liquid dispensing device which prevents the user from dispensing a double-dose.

In addition, known dispensing systems do not adequately allow users to prime the system when empty, or partially empty, for example when a chemical container is replaced once used up. The system often comprises significant lengths of tubing used to receive the chemical, and to deliver the chemical, which require filling before the dispensing device is fully operational. Again, although known systems provide so-called "prime over-ride" features, problems remain, such as the user having to use complex movements to initiate the prime over-ride feature.

It is therefore an object of the present invention to provide an improved prime over-ride feature for a liquid dispensing device.

According to a first aspect of the present invention, there is provided a liquid dispensing device having a main housing, comprising: a liquid delivery pump, comprising: an inlet; an outlet; a piston, disposed in a cylinder, the piston being movable in a liquid delivery direction between a first position and a second position, and in a liquid priming direction between the second position and the first position; and resilient means for biasing the piston in the liquid priming direction; an operating button, movable between a first position and a second position, and configured to act on the piston to move the piston in the liquid delivery direction; and resilient means for biasing the operating button in the liquid priming direction independently of said piston. The operating button comprises locking means, configured to engage with the main housing to substantially prevent movement of said operating button in the liquid delivery direction until the operating button and the piston are in their respective first positions.

By providing an operating button with locking means to substantially prevent movement of the button until the piston is in the first position the user is prevented from dispensing the liquid until the pump is in a fully primed condition. Therefore, advantageously, the user is prevented from dispensing an unknown volume of liquid—a so-called "double-dose". In effect, the liquid dispensing device is provided with an interlock to prevent the operating button being depressed without the piston being in the fully primed position, and to prevent the piston being depressed without the operating button being in the first position.

Upon the operating button and the piston being in their respective first positions, the piston preferably abuts a portion of the operating button, such that on the user pressing the operating button to move it in the delivery direction, the operating button acts on the piston to move the piston in the delivery direction to dispense the volume of liquid contained within the cylinder.

Preferably, the locking means comprises at least one arm having a proximal end and a distal end, the distal end being configured to engage with a portion of the main housing. The or each arm is movable from a first position, in which the distal end is disengaged from the portion of the main housing, to a second position, in which the distal end is engaged with the portion of the main housing. In a preferred embodiment, the locking means comprises two such arms, disposed on either side of the operating button.

Upon the distal end of the or each arm being disengaged from the portion of the main housing, the operating button is free to move relative to the main housing.

The locking means preferably comprises resilient means for biasing the or each arm to the second position. The locking means, operating button and piston being arranged such that upon the operating button and the piston being in their respective first positions, the piston acts on the or each arm, to move the or each arm to the first position. Preferably, the piston acts on the proximal end of the or each arm.

The resilient means for biasing the or each arm is preferably a spring, more preferably a helical spring. Where a plurality of arms are provided, the resilient means preferably comprises one spring, configured to bias each arm to the second position.

As will be appreciated, the biasing force applied by the resilient means to the piston in the liquid priming direction is sufficient to both prime the pump with liquid, and to overcome the biasing force of the resilient biasing means for biasing the or each arm to the second position.

The distal end of the or each arm preferably comprises a tooth, the portion of the main housing comprising at least one corresponding recess configured to receive said tooth. Alternatively, the distal end of the or each arm may be square, the portion of the main housing comprising at least one corresponding recess configured to receive said square end.

The or each tooth preferably comprises an engaging surface, substantially perpendicular to, and arranged to face, the liquid delivery direction, the or each recess comprising a corresponding engaging surface, substantially perpendicular to the liquid delivery direction, and arranged to face the liquid priming direction. The portion of the main housing preferably comprises a plurality of recesses spaced apart along the portion of the main housing in the liquid delivery direction. The plurality of spaced apart recesses are preferably arranged in a saw tooth configuration to form a ratchet.

In this way, the user is prevented from depressing the operating button at any point between the second position and the first position, unless the piston is engaged with the proximal end of the or each arm, since the or each arm will engage with any one of the plurality of spaced apart recesses.

Where the locking means comprises two arms, correspondingly, the main housing comprising two portions for engaging with respective ones of the two arms.

The main housing may comprise two main portions, a first main portion onto which is mounted the liquid delivery pump, and a second main portion onto which is mounted the operating button. Preferably, the recesses for receiving the or each arm of the locking means are provided on the second main portion.

In one embodiment, the second main portion of the main housing is hingedly coupled to the first main portion to enable access to the liquid delivery pump, and other features within the housing. The first main portion and the second main portion may be retained together by a lock.

The or each arm of the locking means is preferably rotatable about a pivot at a medial point of the arm. The or each arm is preferably substantially L-shaped, the medial point about which the arm is rotatable being adjacent the corner of the L-shaped arm. The pivot preferably comprises a pin extending transverse to the longitudinal length of the arm, the pin being rotatable within a corresponding recess in the operating button.

As used herein, the term "longitudinal" refers to the direction along the length of the elongate arm, the term "transverse" referring to the direction across the width of the elongate arm, that is to say perpendicular to the longitudinal direction.

The pin preferably extends from each side of said arm, the operating button comprising two corresponding recesses for receiving each end of said pin.

The or each recess is preferably an elongate slot, the pivot pin being slidable within said elongate slot from a first position to a second position. The major axis of said elongate slot is preferably substantially parallel to the liquid delivery direction.

Where the or each locking means arm comprises a tooth, the tooth comprises a recess configured to engage with the operating button upon the pivot pin of the arm being in the second position within the elongate slot, and upon the arm being in the second position.

In a preferred embodiment, the operating button is formed of a hollow cylinder having a closed end. The hollow cylinder is preferably a thin walled cylinder. In this embodiment, the recess in the or each tooth of the locking means arm engages with the edge of the thin walled cylinder of the operating button. The recess in the tooth is preferably sized to fit about the edge of the cylinder.

Advantageously, providing such a tooth prevents the locking means arm from disengaging from the recess in the main housing upon the user applying significant force to the operating button. As the user presses on the operating button, the pivot pin slides within the elongate slot from the first position to the second position, and thus enables the recess in the tooth to engage with the button.

The or each arm of the locking means is preferably arranged to be adjacent the inner wall of the operating button. In this way, the operating button is free to move along the liquid delivery direction with impinging on the liquid delivery pump.

The liquid dispensing device preferably further comprises at least one indicator configured to indicate to a user upon the operating button and the piston are in their respective first positions. Providing an indicator in this manner enables the user to see when the liquid dispensing device is ready to dispense liquid. Advantageously, this may reduce the risk of the user applying too much force to the operating button and damaging the device when the device is in the locked configuration waiting for the piston to return to the first, primed, position.

In one embodiment, the device comprises two indicators. The or each indicator is preferably provided adjacent the closed end of the operating button, the closed end of the operating button having a window for enabling a user to view the indicator. The external side of the closed end of the operating button may comprise a transparent plate, configured to cover the or each window. The side of the transparent plate adjacent the external side of the closed end of the operating button may comprise indicia. The indicia may be operating instructions, company logos, or the like.

The or each indicator preferably comprises: a resilient member having an indicator portion; a linear cam member; and resilient biasing means, the resilient biasing means being arranged to bias the resilient member such that the resilient member follows a profile of the linear cam member to move the indicator portion from a first position where the indicator portion is visible through the window to a second position where the indicator portion is not visible through the window, and wherein upon the operating button and the piston being in their respective first positions, the piston is arranged to act on the resilient member to maintain the indicator portion in the first position such that it is visible through the window.

The resilient member of the indicator is preferably coupled to the proximal end of the locking means arm. The resilient member and the arm are preferably integrally formed. The resilient member of the indicator and the arm may be coupled such that they form an L-shape, the resilient member extending transverse to the longitudinal length of the arm. Where the locking means comprises two arms, preferably two indicators are provided, and the first indicator extends in a first transverse direction, and the second indicator extends in a second transverse direction opposite the first.

The liquid dispensing device preferably further comprises a dosing ring configured to limit movement of said operating button in the liquid delivery direction, the dosing ring being adjustably mounted on a support member to enable the volume of liquid dispensed to be adjusted. The dosing ring preferably enables the volume of liquid to be dispensed be adjusted in predefined increments. The increments may be about 5 ml, about 10 ml, or about 20 ml. The volume may be adjusted from about 5 ml to about 100 ml, preferably from about 5 ml to about 50 ml, more preferably from about 5 ml to about 30 ml.

According to a second aspect of the present invention, there is provided a liquid dispensing device having a main housing. The device comprises: a liquid delivery pump, comprising: an inlet; an outlet; a piston, disposed in a cylinder, the piston being movable in a liquid delivery direction between a first position and a second position, and in a liquid priming direction between the second position and the first position; and resilient means for biasing the piston in the liquid priming direction. The device further comprises: an operating button, movable between a first position and a second position, and configured to act on the piston to move the piston in the liquid delivery direction; resilient means for biasing the operating button in the liquid priming direction independently of said piston; and a dosing ring configured to limit movement of said operating button in the liquid delivery direction, the dosing ring being adjustably mounted on a support member to enable the volume of liquid dispensed to be adjusted.

Advantageously, providing such a dosing ring enables the volume of liquid be metered accurately and efficiently. By restricting full movement of the operating button in the delivery direction to meter the liquid, the liquid delivery pump always returns to a fully primed state.

The dosing ring is preferably adjustably mounted on said support member by a bayonet-type fitting, said dosing ring comprising a male portion of the bayonet fitting, and the support member comprising a plurality of female portions of the bayonet member, the plurality of female portions being disposed along the liquid priming direction to enable selection of the volume of liquid to be dispensed.

As described above, the dosing ring preferably enables the volume of liquid to be dispensed be adjusted in predefined increments. The increments may be about 5 ml, about 10 ml, or about 20 ml. The volume may be adjusted from about 5 ml to about 100 ml, preferably from about 5 ml to about 50 ml, more preferably from about 5 ml to about 30 ml.

The operating button preferably comprises a plurality of elongate dosing members disposed annularly about said button, the dosing ring comprising a corresponding plurality of dosing stops disposed annularly about said dosing ring, said dosing members being aligned with said dosing stops such that movement of said operating button is limited by the dosing members abutting said dosing stops.

The operating button is preferably rotatable about the liquid delivery direction between a first orientation and a second orientation, such that in the first orientation said dosing members are aligned with said dosing stops and in the second orientation said dosing members are not aligned with said dosing stops. By enabling the operating button to rotate in such a manner, the dosing ring can be bypassed to enable the full volume of the cylinder to be dispensed.

The liquid dispensing device preferably further comprises resilient biasing means configured to bias said operating button to the first orientation. Advantageously, biasing the operating button in this manner prevents the user from accidentally dispensing more than the metered volume of liquid.

The main housing preferably comprises an elongate guide channel, the channel extending substantially parallel to the liquid delivery direction, wherein said operating button comprises a guide member arranged to engage with, and slide within, the elongate guide channel when the operating button is in the second orientation.

Advantageously, providing such a guide channel, the user is not required to maintain the rotational force on the operating button as the button is being pressed to dispense the liquid. A more ergonomic dispensing device is therefore provided.

The main housing preferably comprises a further elongate guide channel, the channel extending substantially parallel to the liquid delivery direction and adjacent the elongate guide channel, wherein the guide member of the operating button is arranged to engage with, and slide within, the further elongate guide channel when the operating button is in the first orientation.

Advantageously, providing a further guide channel prevents the operating button from rotating during normal use of the dispensing device to dispense the metered volume of liquid.

The operating button may be rotatable by between about 10 degrees and about 30 degrees. Preferably between about 15 degrees and about 25 degrees, and in one preferred embodiment about 20 degrees.

The liquid dispensing device may further comprise a locking means configured to prevent rotation of said operating button when in a locked configuration, and allow rotation of said operating button when in an unlocked configuration.

The locking means preferably comprises: a key member slidable between a first position, in which a distal end of the key member is engaged with the operating button, and a second position, in which the distal end of the key is disengaged from the operating button; and a biasing means for biasing the key member to the first position.

The key member may be slidable in a direction substantially perpendicular to the liquid delivery direction, wherein said key member comprises a linear cam, such that acting on the linear cam in a direction substantially parallel to the liquid delivery direction slides the key member from the first position to the second position.

The locking means may comprise a button, configured to act on the key member to slide said key member from the first position to the second position.

Alternatively, the locking means comprises an operating key, configured to act on the key member to slide said key member from the first position to the second position.

Any feature in one aspect of the invention may be applied to other aspects of the invention, in any appropriate combination. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Generally, the liquid dispensing device of the present disclosure is a push button type, wall mounted displacement pump that dispenses concentrate chemical at a dosage of between 5-30 ml into a bottle/sink/bucket by means of an outlet nozzle.

Figure 1:
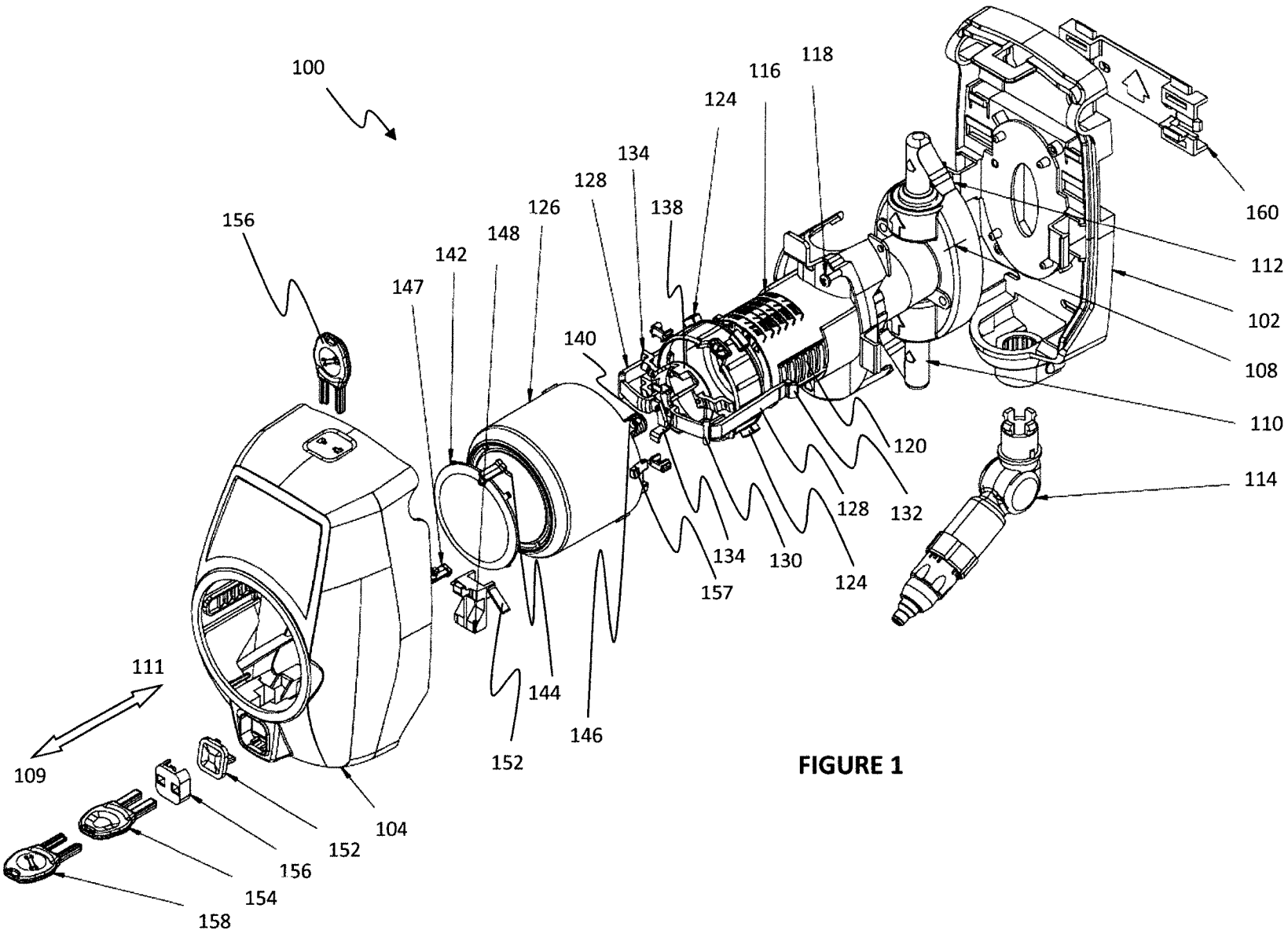
FIG. 1 shows an exploded view of a liquid dispensing device according to one embodiment of the present invention.

FIG. 1 shows exploded view of a liquid dispensing device 100. The liquid dispensing device comprises a main housing formed of a first portion 102, and a section, lid, portion 104. The lid portion 104 is hingedly coupled to the first portion 102 by hinge 106. The dispensing device 100 further comprises a liquid delivery pump assembly 108, which comprises a piston (not shown), a cylinder (not shown) a liquid inlet 110, a liquid outlet 112, and a spring (not shown) for biasing the piston in a liquid priming direction. The piston return time, i.e. the time it takes to prime the pump, is controlled using an inlet metering tip, inserted into the inlet of the delivery pump. By providing different sized metering tips, the return time may be controlled. A seal is provided between the piston and the cylinder to prevent leakage. The seal may be interchangeable to enable different chemicals to be used. For example, the seal may be of PTFE, such as a sprung energised PTFE seal. The inlet 110 and outlet 112 are provided with check valves to prevent liquid flow in the incorrect direction. The check valves may be o-ring type valves, or flexible face type seals. The material of the seals may be chosen in dependence on the chemical being used. For example the seals may be formed of polypropylene. An outlet nozzle 114 is provided on the first portion 102 of the main housing, the outlet nozzle is in fluid communication with the liquid outlet 112 of the delivery pump assembly 108. The liquid inlet 110 is in fluid communication with a container (not shown) for storing the liquid to be dispensed.

In order to enable the dispensing device to be used in a variety of situations, and for either filling bottles, sinks or buckets, different lengths of hose may be provided to be coupled with the outlet nozzle 114. In a further example, the nozzle 114 is not directly coupled to the main housing, rather it is coupled via a length of hose which enables the nozzle to be positioned in a location appropriate for filling larger containers, such as buckets. In this further example, the nozzle may be mounted directly to a wall, or the like.

The housing portions 102 and 104 are injection moulded plastic, such as Polypropylene (102) & ABS/ASA (104).

The liquid delivery pump assembly 108 operates by the spring biasing the piston in a liquid priming direction 109 to draw liquid into the cylinder through the liquid inlet 110. When the pump is fully primed the volume of liquid contained within the cylinder, in this example, is 30 ml. The pump is now ready to dispense the liquid. On the piston being moved in a liquid delivery direction 111 the piston forces liquid through the liquid outlet 112 and out of the outlet nozzle 114.

The first portion 102 of the main housing, further comprises a support structure 116, for example mounted to the first portion 102 by fixing 118, which is provided with a plurality of female bayonet-type fittings 120, the male bayonet-type fitting being provided in a dosing ring 122. The dosing ring comprises a plurality of dosing stops 124, disposed annularly about the ring. The dosing stops are projections extending from the outer surface of the dosing ring. The female bayonet-type fittings are spaced apart along the support structure 116 to enable the dosing ring to be provided in a plurality of positions. The operation of the liquid delivery pump, and the dosing ring is described in detail below.

The lid portion 102 has an operating button 126 coupled thereto. The operating button is provided with a locking device which comprises two locking arms 128, rotatably mounted to the inside of the operating button about pivot pins 130. Each locking arm 128 comprises a tooth 132 at a distal end. The proximal end of each locking arm is provided with an indicator 134. As can be seen, each locking arm is substantially L-shaped, the pivot pin being located at the corner of the L-shape. The locking arms are mounted to the operating button 126 by portions 136. The portions 136 may be integrally formed in a mounting portion 138 which is mounted to the operating button 126 by a clip, for example a clip integrally moulded with the portions 136. Alternatively, the portions may be mounted by fixings or adhesive. The locking device further comprises a spring 140 configured to act on the internal surface of the operating button 126, and on the proximal end of the locking arms 128. The operation of the locking device is described in further detail below.

The operating button further comprises a clear plate 142, which may be provided with indicia such as company logos, or operating instructions, on the side adjacent the outside surface of the operating button. The clear plate 142 covers indicator windows 144, which are disposed above the indicators 134.

The operating button is rotatable about the liquid delivery direction, from a first orientation in which dosing members on the inner surface of the operating button are in alignment with the dosing stops of the dosing ring, to a second orientation in which the dosing members are not in alignment with the dosing stops. Two springs (not shown) are provided which are coupled to the outside surface of the operating button on lugs 146, and to the support structure 116 by lugs 147. The springs bias the operating button 126 both to the first orientation, and in the priming direction 109. A locking device 148 is provided which prevents rotation of the operating button 126 from the first orientation to the second orientation. The locking device 148 comprises an engaging lug 150, a resilient spring 152 for biasing the engaging lug to a locked position, and an operating button 152, or operating key 154. When the locking device 148 is provided with a locking key 154, a cover plate 156 having keyed holes is provided instead of the button 152. A further key 158 may be provided which also unlocks the lid portion 104 from the first portion 102 enabling the main housing to be opened.

The operating button is further provided with lugs 157 which are arranged to run within a first guide channels (not shown) when the operating button is in the first orientation, and in second guide channels (not shown) when the operating button is in the second orientation. A first set of guide channels, comprising a first guide channel and a second guide channel, are provided on a first side of the lid portion 104. A second set of guide channels, also comprising a first guide channel and a second guide channel, are provided on a second side of the lid portion 104, diametrically opposite the first set of guide channels. The channels are elongate and are arranged such that the length of the channel is substantially parallel to the delivery direction 111. The operation of the locking device 148 is described in further detail below.

The lid portion 104 is provided with a first plurality of recesses 158 disposed diametrically opposite a second plurality of recesses (not shown). The recesses 158 form a ratchet arrangement for receiving the tooth 132 of the locking arm 128.

A mounting plate 160 is provided for mounting the dispensing device 100 to a wall or the like.

The operation of the locking device of the operating button 126 will now be described in further detail, in particular with reference to FIGS. 2, 3, 4 and 5. The locking device is provided to prevent the user from pressing the operating button in the delivery direction 111 until the piston is in the fully primed position. This is a so-called double dose lock-out feature.

Figure 2:
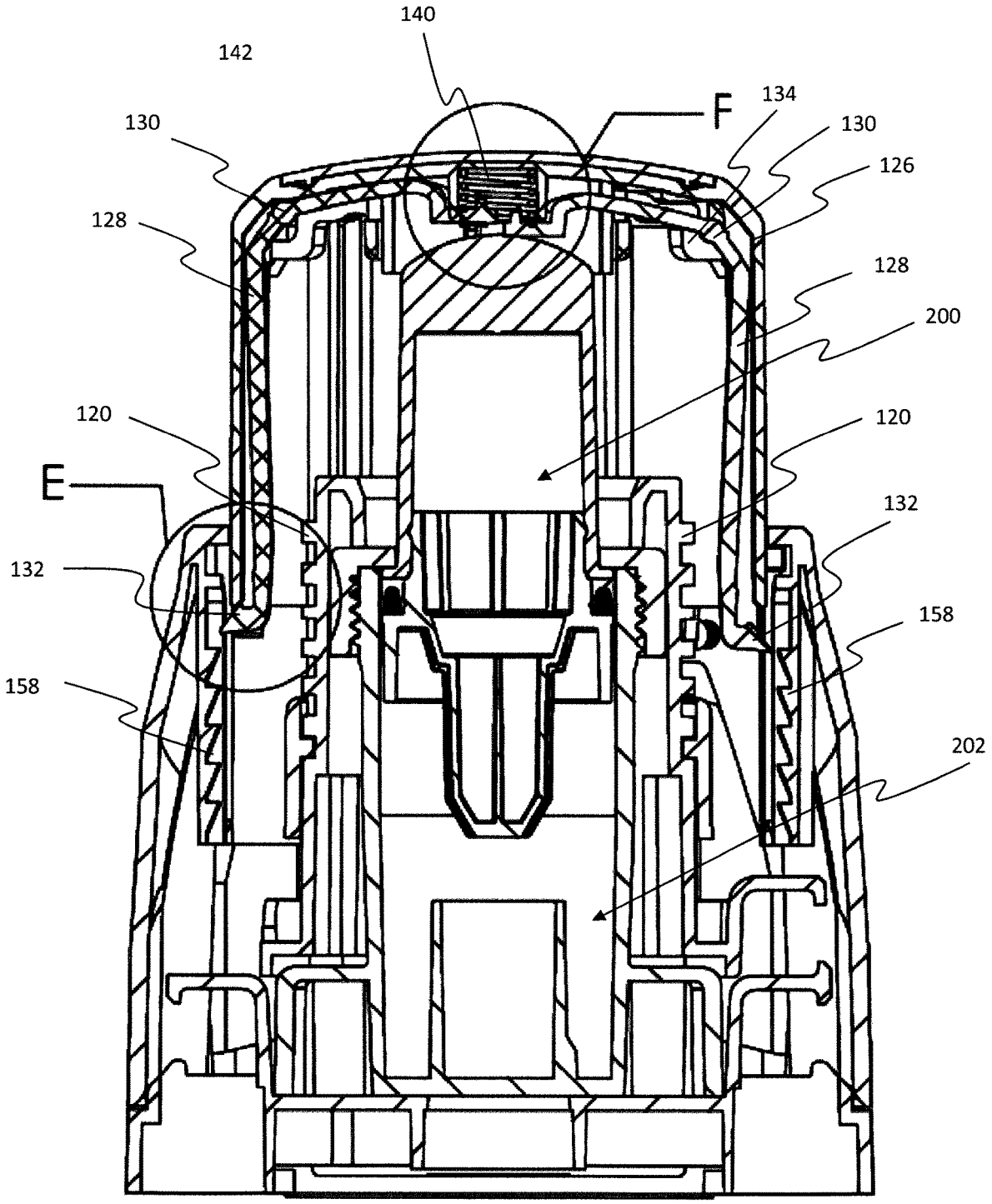
FIG. 2 shows a cross-sectional view of the liquid dispensing device of FIG. 1.
Figure 5:
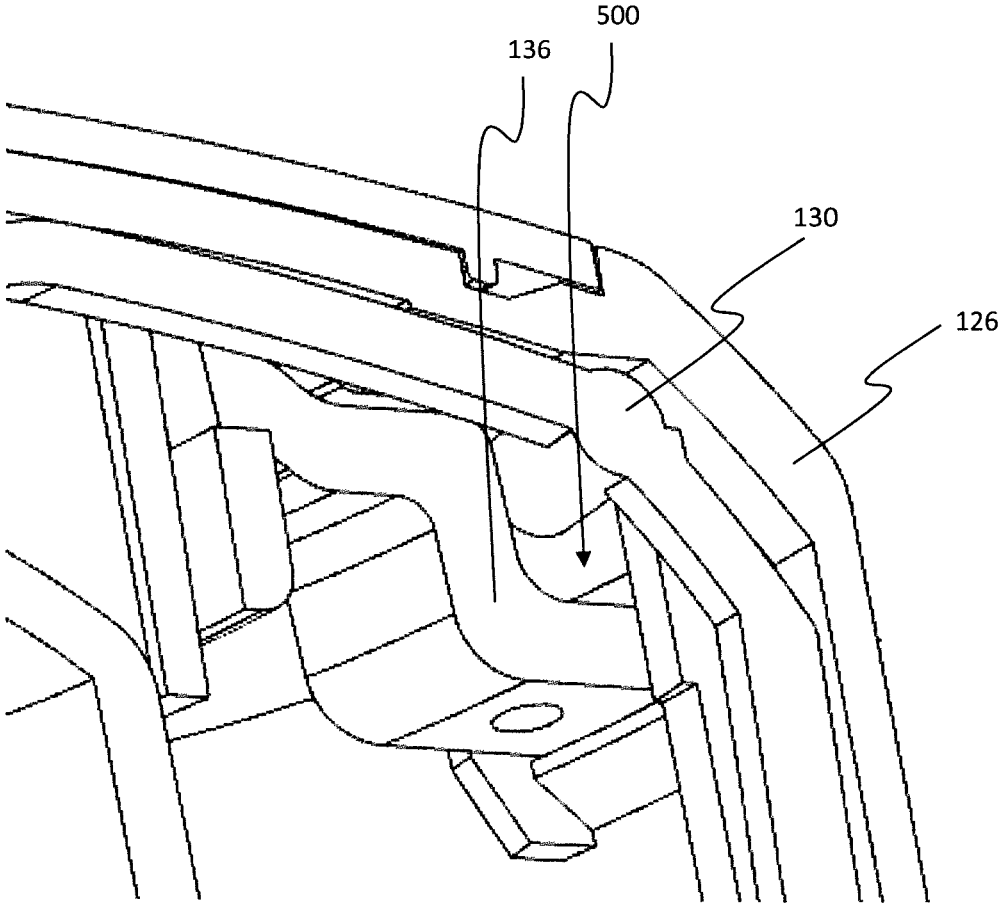
FIG. 5 shows a yet further detail cross-sectional view of a portion of the liquid dispensing device of FIG. 1.

As seen in FIG. 2, the arms 128 of the locking device are pivoted about pins 130. The pins are retained within corresponding elongate slots 500, as shown in FIG. 5. As such, the pins are able to both rotate, and slide in a direction substantially parallel to the delivery direction 111. Upon the piston 200 being in the primed, first position, the external surface of the piston engages with both the operating button, and with the proximal ends of the arms 128. Upon doing so, the piston acts against the spring 140, compressing it, and moving the proximal end of the arms 128 in the priming direction 109. Moving the proximal end of the arms 128 in the priming direction causes the arms to pivot about the pivot pins 130 and move the distal, toothed, end of the arms 128 inwards towards the longitudinal axis of the operating button. The operating button is now freely movable in the delivery direction 111 which enables the user to depress the button 126 and dispense the liquid within the cylinder 202.

Once the liquid has been fully dispensed, the user removes the force from the operating button, which then returns to a first position, fully extended in the priming direction 109. The operating button 126 returns to this position independently from the piston 200, which returns more slowly because it is priming the cylinder with liquid, being drawn through the metering tip in the inlet.

Figure 3:
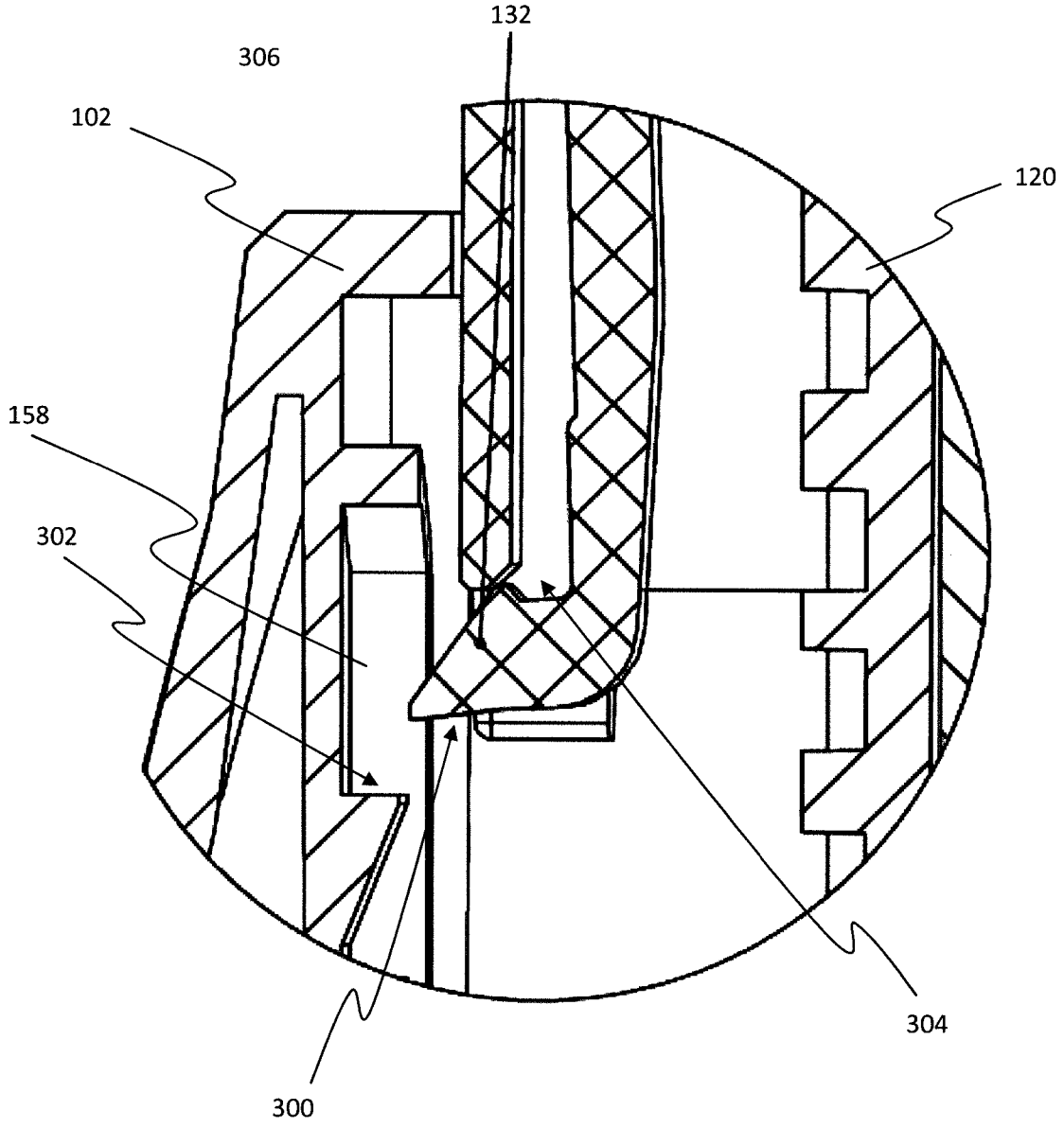
FIG. 3 shows a detail cross-sectional view of a portion of the liquid dispensing device of FIG. 1.

In this configuration, where the piston 200 is not in contact with the operating button 126, and therefore not in contact with the arms 128 of the locking device, the spring 140 biases the proximal end in the delivery direction 111, which in turn causes the arms 128 to pivot about pivot pins 130 and move the distal, toothed, end of the arms 128 outwards away from the longitudinal axis of the operating button 126. In doing so, the tooth 132 may engage with the recesses 158 preventing movement of the operating button in the delivery direction 111. In detail, as shown in FIG. 3 which corresponds to detail E as shown in FIG. 2, each tooth comprises an engaging surface 300 which engages with a corresponding engaging surface 302 in the recess 158. Depending on the position of the operating button 126 along the path between the first position and a second, fully depressed, position, the teeth 130 of the arms 128 will engage with different ones of the recesses 158. As can be seen, the recesses 158 are arranged in a saw tooth arrangement to enable different ones of the recesses to be engaged.

Figure 4:
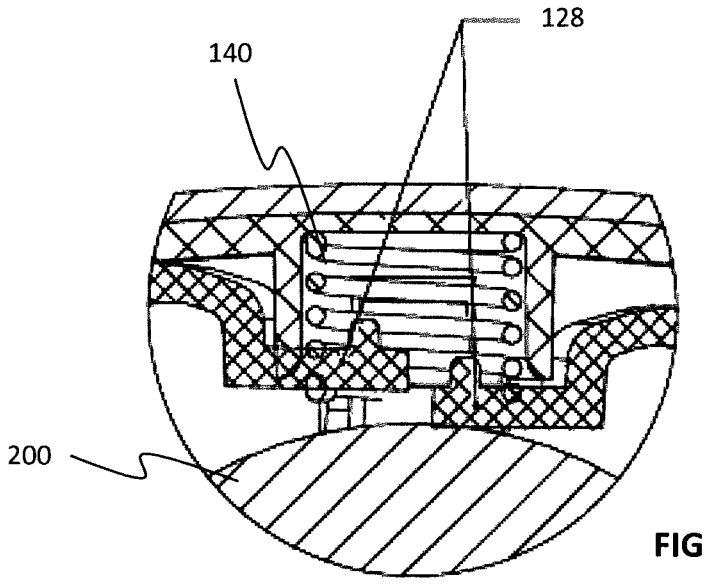
FIG. 4 shows a further detail cross-sectional view of a portion of the liquid dispensing device of FIG. 1.

FIG. 4, which corresponds to detail F shown in FIG. 2, shows a detail of the proximal ends of the arms 128.

In addition, each tooth 130 comprises a recess 304. The recess 304 is configured to engage with the edge 306 of the operating button 126 upon the user pressing the operating button 126 when the arms 128 are in the engaged position. As the user presses the button in this configuration, the pivot pins 130 slide within the elongate slot they are retained within to move the edge 306 of the operating button relative to the tooth 132 to engage with the recess 300. In this way, the teeth 132 of the locking device are retained within the recesses 158 even when the user applies force to the operating button 126. The position of the pivot pin 130 within the elongate slot 500 can be seen in further detail in FIG. 5.

Figure 6:
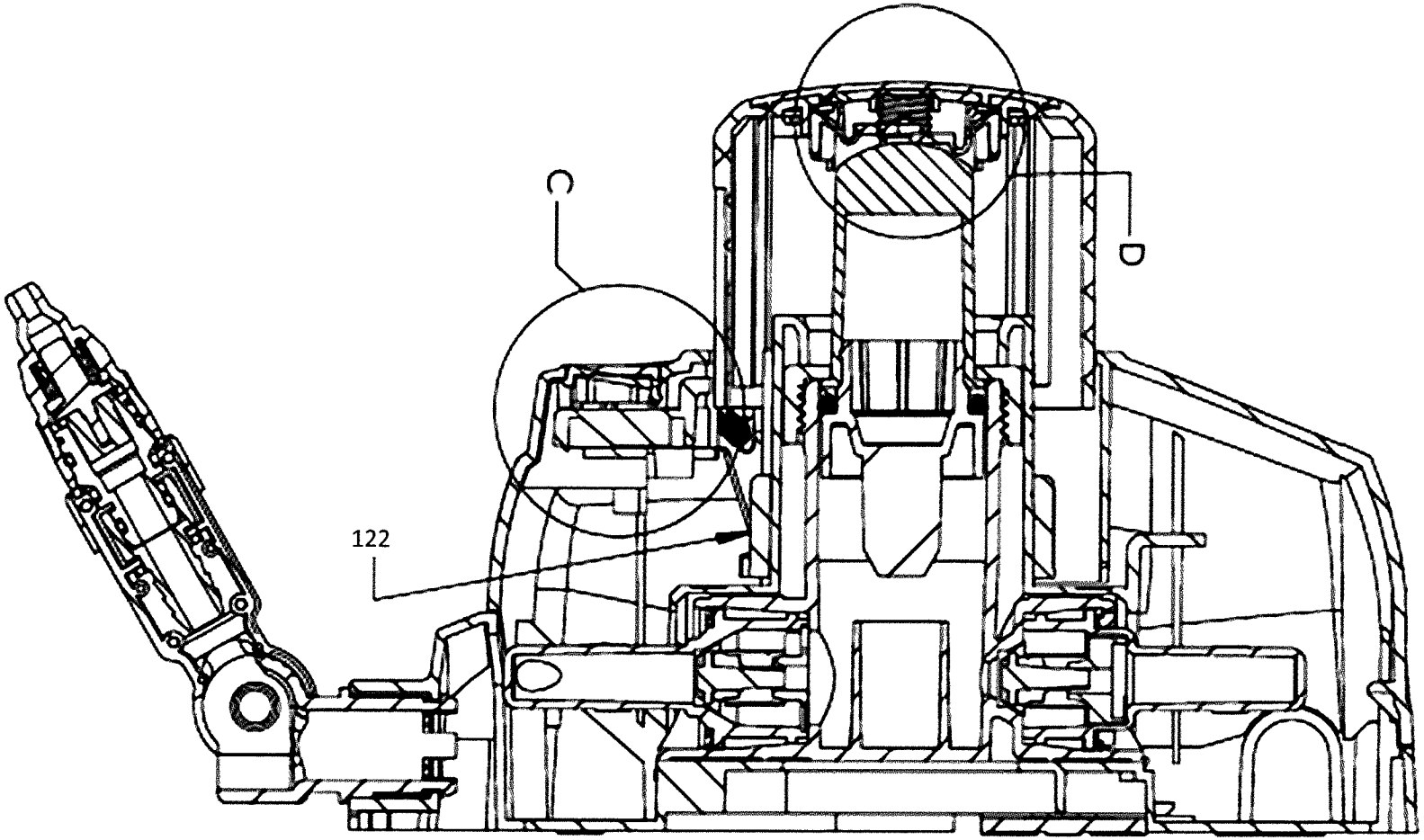
FIG. 6 shows an alternative cross-sectional view of the liquid dispensing device of FIG. 1.

The operation of the indicator 134 will now be described in further detail, in particular with reference to FIGS. 6, 7 and 8. The cross-section shown in FIG. 6 is orthogonal to the cross-section shown in FIG. 2. The indicator is provided to inform the user when the dispensing device 100 is primed and ready for dispensing. That is to say, when the locking device is in the disengaged configuration. As can be seen from FIG. 7 (detail D shown in FIG. 6) and FIG. 8, the indicator 134 is an assembly comprising a resilient indicator member 700, a linear cam member 702 and the spring 140. It is noted that the spring 140 acts on both the arms 128 of the locking device and the resilient indicator members 700. Indeed, as can be seen from FIG. 8, the resilient indicator members 700 and the arms 128 are integrally formed.

Figure 7:
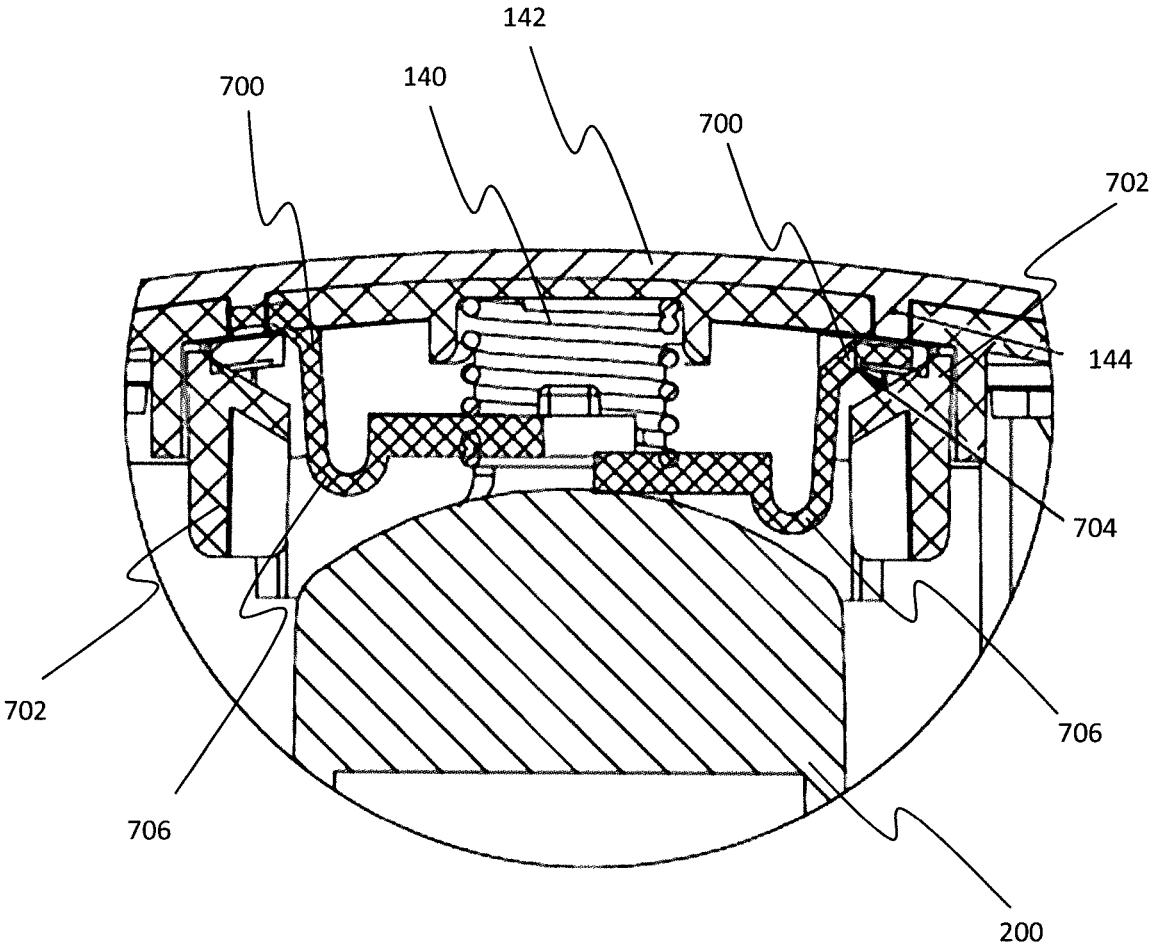
FIG. 7 shows a detail view of the cross-section shown in FIG. 6.

As can be seen in FIG. 7, the piston 200 acts on the resilient indicator members 702 when in contact with the operating button 126. In this configuration the resilient indicator members 702 are biased to a first end of the linear cam 702, where the indicator portion 704 is visible through the window 144. The indicator portion is preferably green to provide the user with an easily visible indicator. When the piston 200 is not in contact with the resilient indicator members 700, the spring biases the resilient members 702 in the delivery direction 111, which in turn causes the indicator portion to follow the linear cam 702, bending it about the flexible portion 706, and forcing the indicator portion 704 away from the window 144, until it is not visible through the window 144. In one example, the linear cam surface is red to indicate to the user that the device is not ready to use, since the linear cam surface becomes visible through the window in this configuration.

Figure 8:
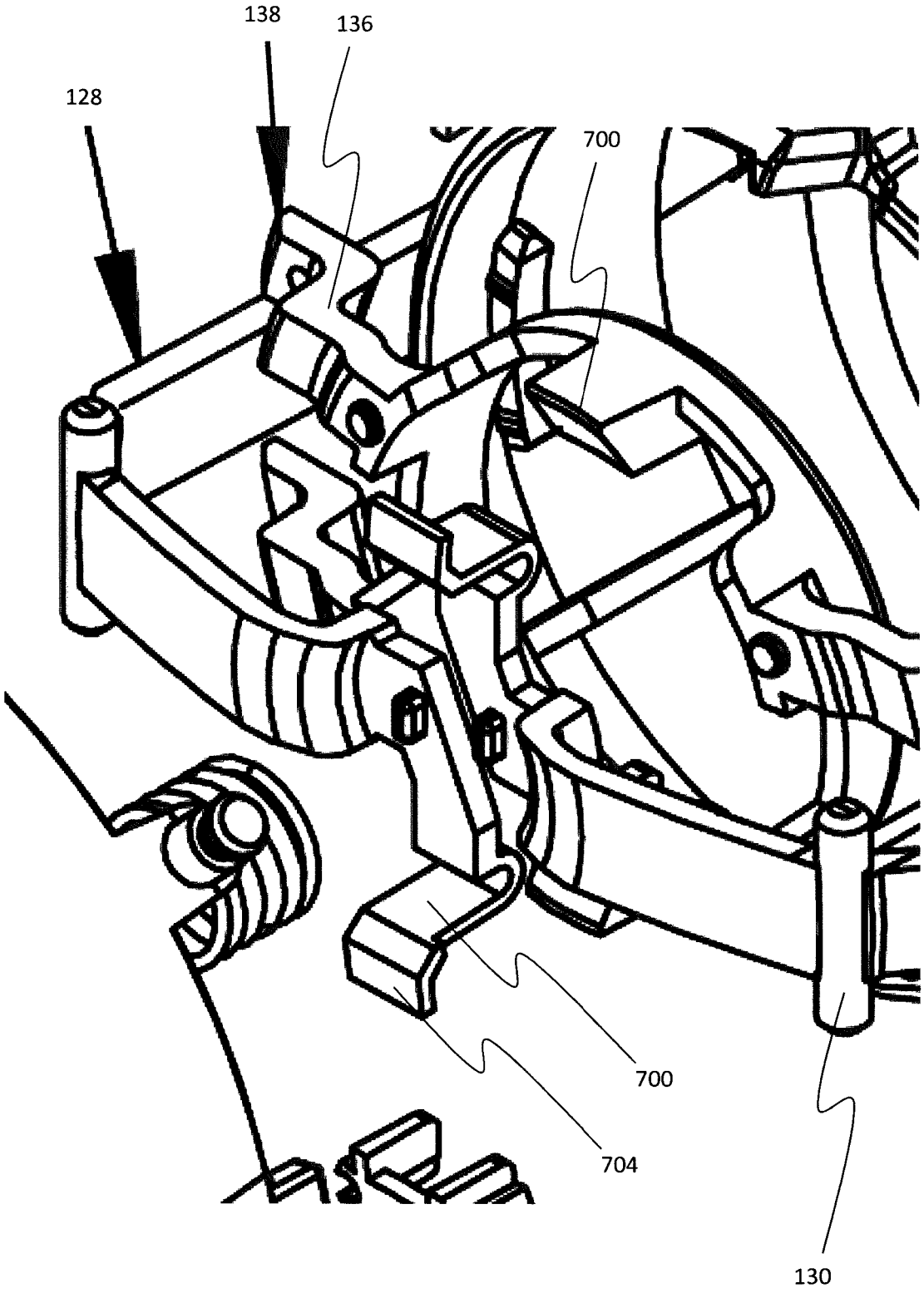
FIG. 8 shows a detail view of the exploded view shown in FIG. 1.

As can be seen in FIG. 8, which is a detail view of the exploded view shown in FIG. 1, the portions 136 forming the pivot point for the locking device arms 128, and the linear cams 702 are integrally formed into the mounting portion 138. In addition, it can be seen that two such indicators 134 are provided, one integrally coupled to each of the locking device arms 128. The two formations are provided in a cross arrangement.

Figure 9:
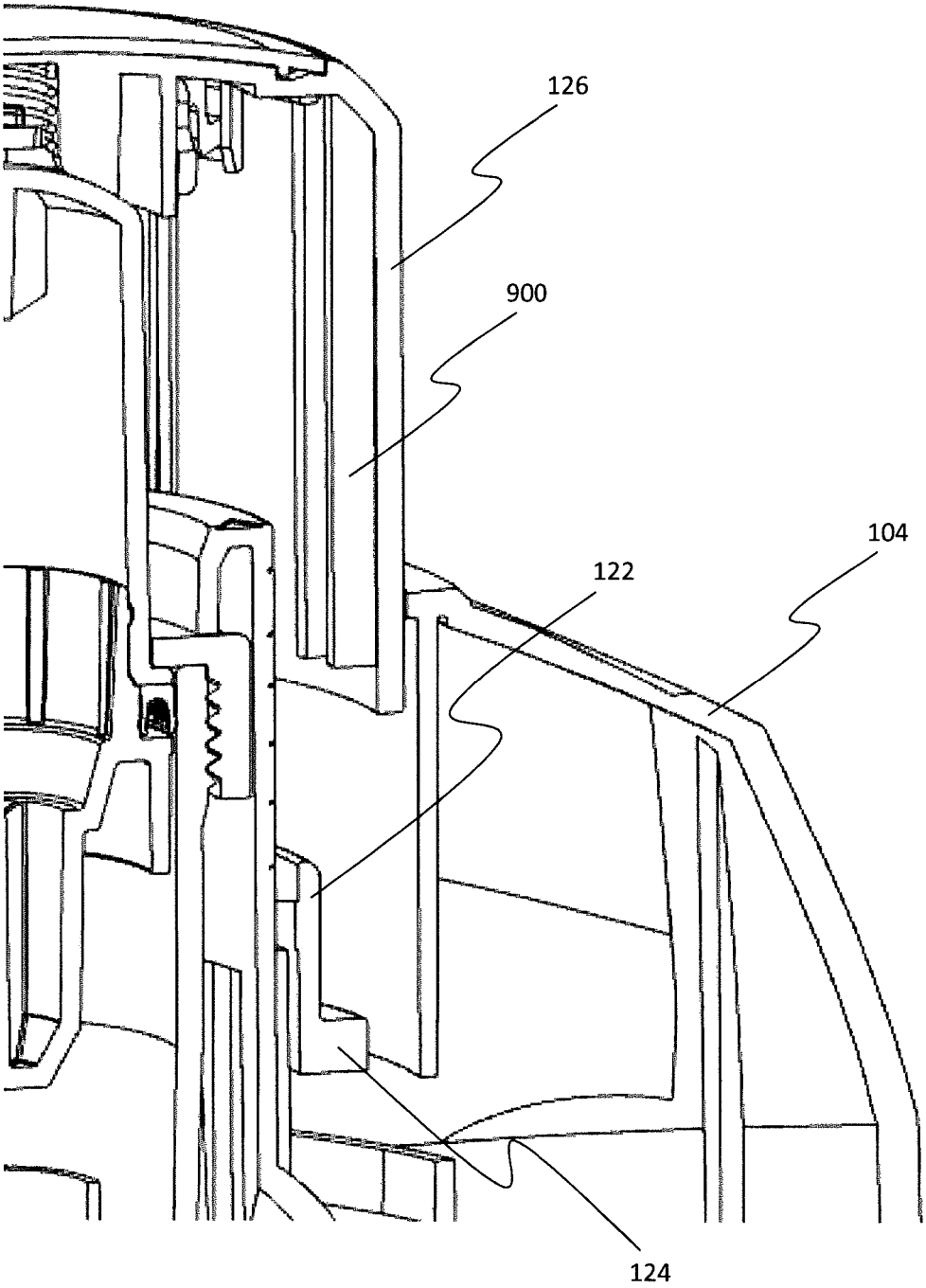
FIG. 9 shows a cross-sectional view of the liquid dispensing device.

The operation of the liquid delivery pump, and in particular the dosing ring 122 will now be described in detail, in particular with reference to FIG. 9. As described above, the dispensing device 100 is operated by the user pressing the operating button 126 in a delivery direction 111. On pressing the button 126 the piston 200 is moved in the delivery direction 111, and forces the liquid contained within the cylinder 202 out through the outlet 112. The operating button continues to move in the delivery direction until the dosing members 900, which are elongate and disposed annularly about the inside surface of the operating button 126, abut the dosing stops 124 on the dosing ring 122. The dosing ring may be moved by twisting the ring 122 to disengage the bayonet type fitting, sliding the ring to a required position, which corresponds to a predetermined volume to be dispensed, and then twisting the ring again to re-engage the bayonet-type fitting. The dosing ring 122, in this example, may be moved to positions which are equivalent to metering 5 ml to 30 ml, in 5 ml increments.

As described above, the operating button is rotatable about its longitudinal axis from a first orientation where the dosing members 900 are aligned with the dosing stops 124, to a second orientation where they are not aligned. In this example, there are six dosing members and dosing stops. When the operating button is in the second orientation, the full cylinder of liquid may be dispensed, even when the dosing ring is set to a smaller volume. This enables the user to re-prime the device more quickly when the liquid runs out.

Figure 10:
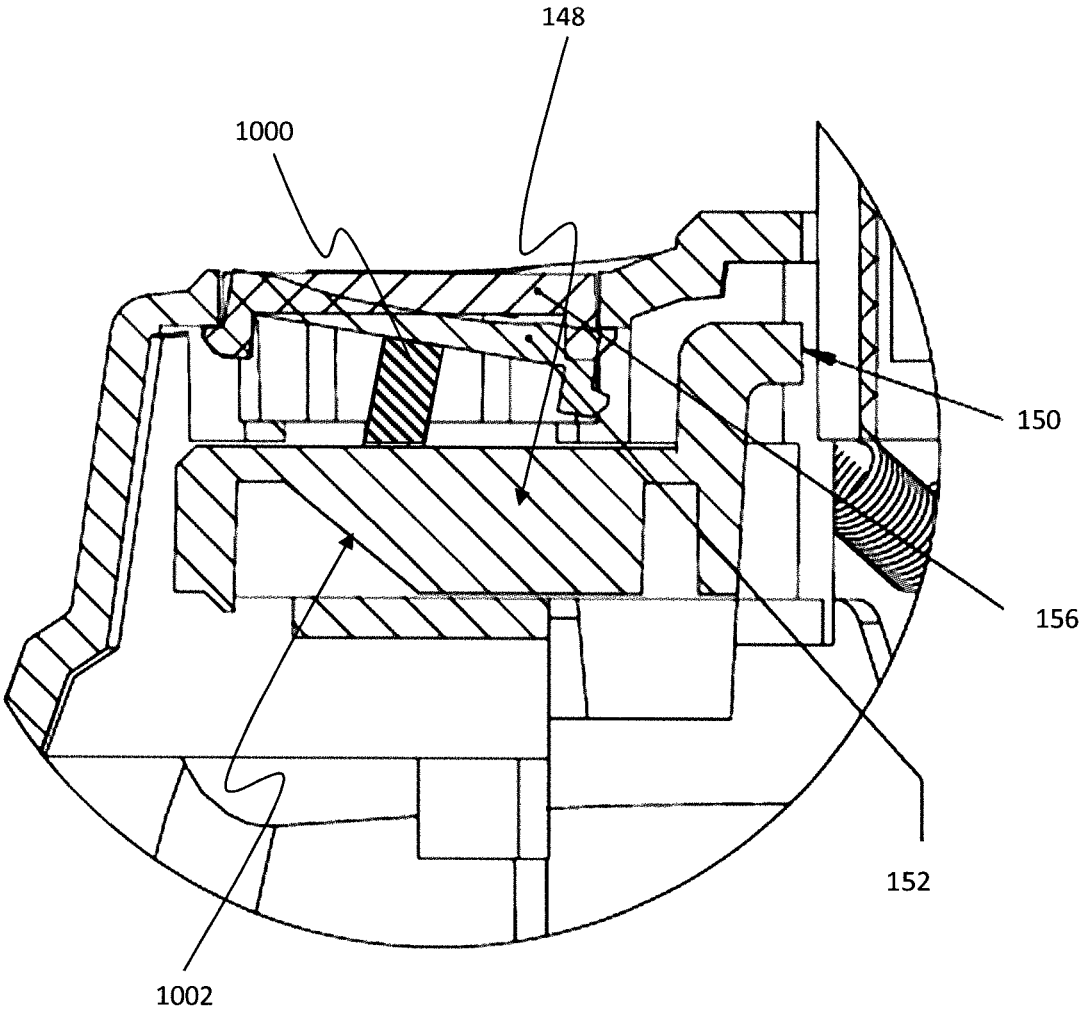
FIG. 10 shows a yet further cross-sectional view of a portion of the liquid dispensing device.
Figure 11:
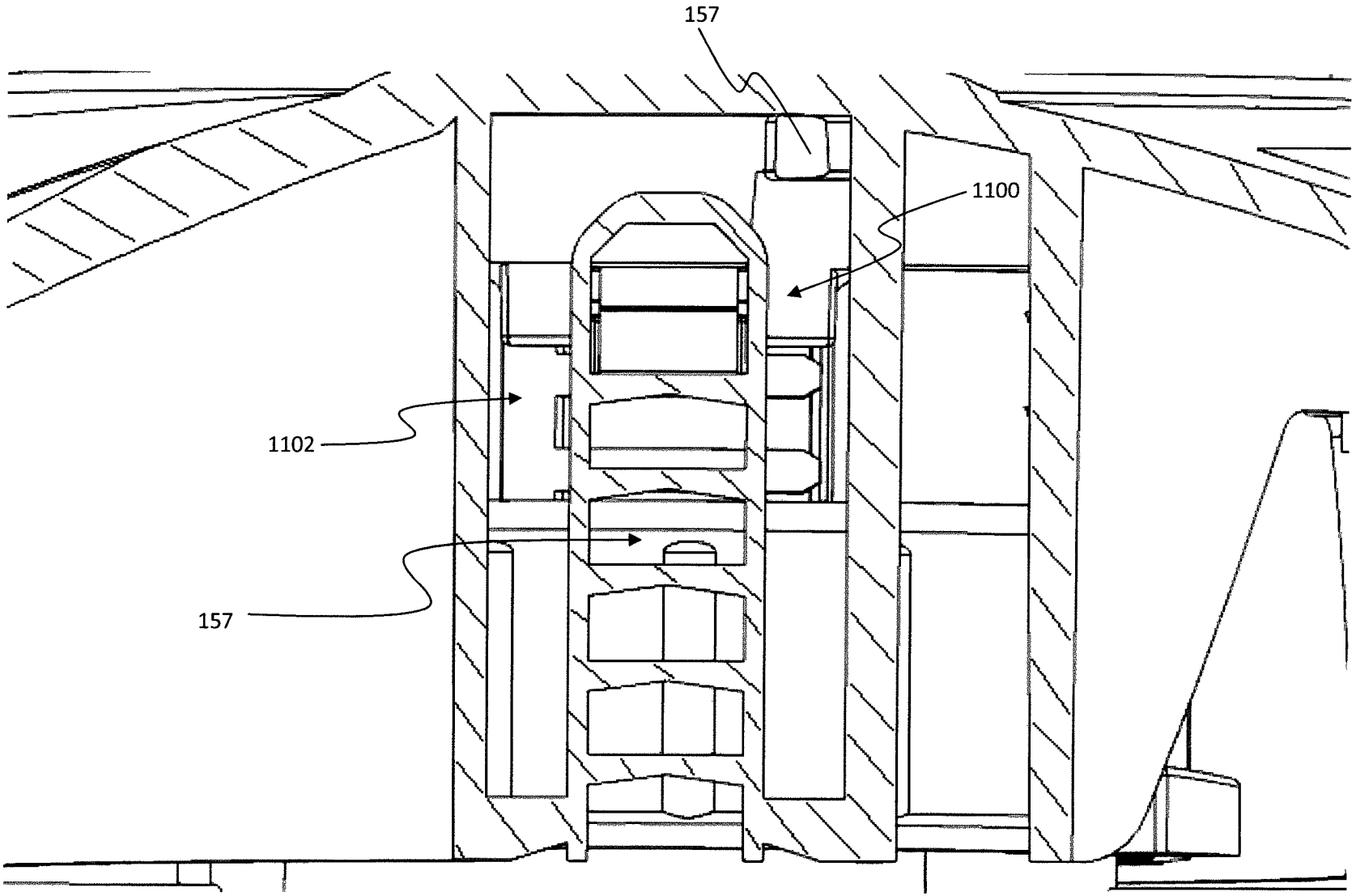
FIG. 11 shows a further detailed cross-sectional view of the liquid dispensing device.

The operation of the locking device 148, known as the prime over-ride feature, will now be described in detail, in particular with reference to FIGS. 10 and 11. The locking device 148 is slidable between a first, locked position, and a second, unlocked position. The locking device 148 is slidable perpendicular to the delivery direction 111, and radially to the longitudinal axis of the operating button 126. When the device 148 is in the first, locked position, the engaging lug 150 is engaged with a corresponding recess in the external surface of the operating button. As such, the operating button is prevented from being rotated about its longitudinal axis, and therefore is maintained in the first orientation, where the dosing ring controls the volume of liquid dispensed. The locking device is biased into this configuration by a resilient spring member.

When the locking device 148 is moved to the second, unlocked, position, the engaging lug is removed from engagement with the operating button, enabling the button to be rotated to the second orientation. The locking device 148 is moved in this way by an operating button 152, having a follower 1000, being pressed by the user. The follower 1000 of the button 152, acts on the linear cam 1002, which forces the locking device 148 out of engagement with the operating button 126.

Alternatively, an operating key 154, 158, is provided which acts directly on the linear cam through a keyed cover plate 156, to which the operating key is matched, thus moving the locking device 148 out of engagement with the operating button 126.

The operating button 152 and the keyed cover plate 156 are preferably provided as inserts, which may be interchanged as required. For example, they may be held in place by resilient formations which engage with the edges of a corresponding hole in the lid portion 104.

As described above, and now described in further detail with reference to FIG. 11, the operating button 126 is further provided with lug 157 which are arranged to run within a first guide channel 1100 when the operating button is in the first orientation, and in a second guide channel 1102 when the operating button is in the second orientation.

A first set of guide channels, comprising a first guide channel 1100 and a second guide channel 1102, are provided on a first side of the lid portion 104. A second set of guide channels, also comprising a first guide channel 1100 and a second guide channel 1102, are provided on a second side of the lid portion 104, diametrically opposite the first set of guide channels. Providing the lugs 157 and guide channels 1100, and 1102, enables the operating button to more easily be pushed by the user. This is because, once engaged with the channel, the operating button may not be rotated about its longitudinal axis, and thus the user need not continue to apply a twisting force on the operating button, while depressing the button 126 to dispense the liquid. As will be appreciated, the lugs and the guide channels are sized such that the lug is a sliding fit within the channel. Finally, as can be seen from FIG. 11, the guide channels are disposed either side of the set of recesses 158.

Figure 13:
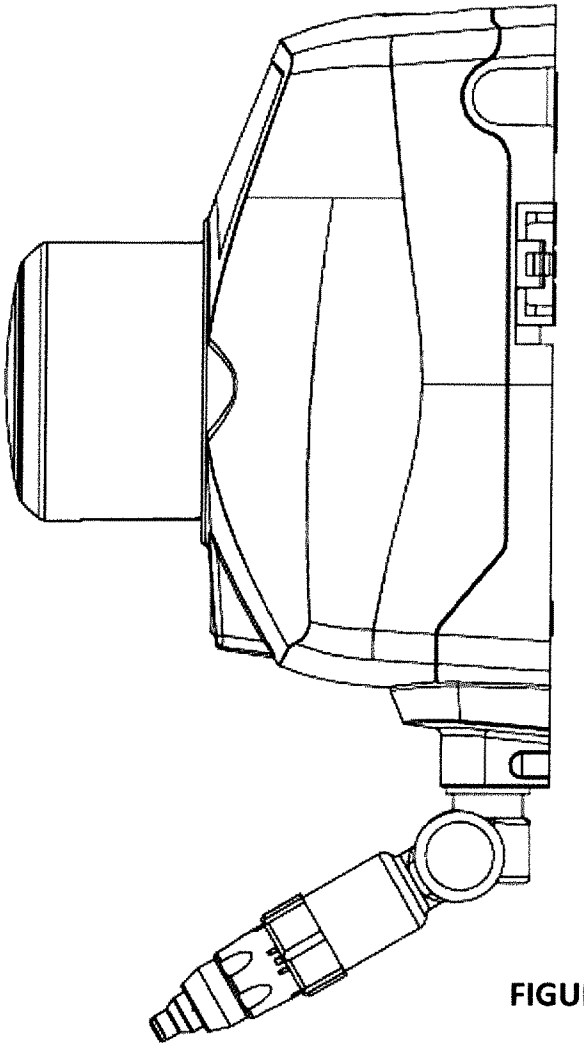
FIG. 13 shows a side view of the liquid dispensing device.
Figure 12:
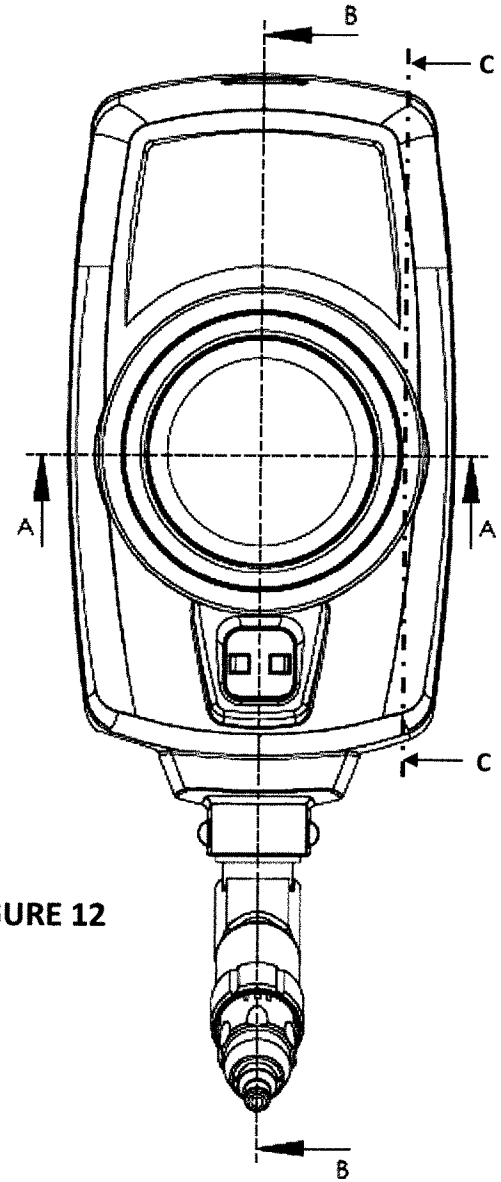
FIG. 12 shows a front view of the liquid dispensing device.

FIGS. 12 and 13 shows a top external view and a side external view of the dispensing device 100. It is noted that the cross-sectional view A-A is shown in FIGS. 2, 3 and 4, the cross-sectional view B-B is shown in FIGS. 6 and 7, and the cross-sectional view C-C is shown in FIG. 11.

The invention claimed is:

1. A liquid dispensing device having a main housing, comprising:

a liquid delivery pump, comprising:

an inlet;

an outlet;

a piston, disposed in a cylinder, the piston being movable in a liquid delivery direction between a first position and a second position, and in a liquid priming direction between the second position and the first position; and a first resilient means for biasing the piston in the liquid priming direction;

an operating button, movable between a first position and a second position, and configured to act on the piston to move the piston in the liquid delivery direction; and a second resilient means for biasing the operating button in the liquid priming direction independently of said piston; wherein, said operating button comprises locking means, configured to engage with the main housing to substantially prevent movement of said operating button in the liquid delivery direction until the operating button and the piston are in their respective first positions.

2. A liquid dispensing device according to claim 1, the locking means comprising at least one arm having a proximal end and a distal end, the distal end being configured to engage with a portion of the main housing, wherein the or each arm is movable from a first position, in which the distal end is disengaged from the portion of the main housing, to a second position, in which the distal end is engaged with the portion of the main housing.

3. A liquid dispensing device according to claim 2, wherein the locking means comprises a third resilient means for biasing the or each arm to the second position, the locking means, operating button and piston being arranged such that upon the operating button and the piston being in their respective first positions, the piston acts on the or each arm, to move the or each arm to the first position.

4. A liquid dispensing device according to claim 2, wherein the distal end of the or each arm comprises a tooth, the portion of the main housing comprising at least one corresponding recess configured to receive said tooth.

5. A liquid dispensing device according to claim 4, wherein the or each tooth comprises an engaging surface, substantially perpendicular to, and arranged to face, the liquid delivery direction, the or each recess comprising a corresponding engaging surface, substantially perpendicular to the liquid delivery direction, and arranged to face the liquid priming direction.

6. A liquid dispensing device according to claim 4, wherein the portion of the main housing comprises a plurality of recesses spaced apart along the portion of the main housing in the liquid delivery direction.

7. A liquid dispensing device according to claim 6, wherein the plurality of spaced apart recesses are arranged in a saw tooth configuration to form a ratchet.

8. A liquid dispensing device according to claim 2, wherein the locking means comprises two arms, correspondingly, the main housing comprising two portions for engaging with respective ones of the two arms.

9. A liquid dispensing device according to claim 2, the or each arm being rotatable about a pivot at a medial point of the arm, the or each arm being substantially L-shaped, and the medial point about which the arm is rotatable being adjacent the corner of the L-shaped arm.

10. A liquid dispensing device according to claim 9, said pivot comprising a pin extending transverse to the longitudinal length of the arm, the pin being rotatable within a corresponding recess in the operating button, said pin extending from each side of said arm, the operating button comprising two corresponding recesses for receiving each end of said pin, wherein the or each recess is an elongate slot, the pivot pin being slidable within said elongate slot from a first position to a second position.

11. A liquid dispensing device according to claim 10, wherein the major axis of said elongate slot is substantially parallel to the liquid delivery direction.

12. A liquid dispensing device according to claim 1, further comprising at least one indicator configured to indicate to a user upon the operating button and the piston are in their respective first positions.

* * * * *